US006116333A

United States Patent [19]

Diem et al.

[11] Patent Number: 6,116,333

[45] Date of Patent: Sep. 12, 2000

[54] TUBE CLEANER RECOVERY SYSTEM

[75] Inventors: Robert P. Diem, Perkasie, Pa.; James F. Echols, Houston, Tex.

[73] Assignee: BetzDearborn Inc., Trevose, Pa.

[21] Appl. No.: 09/286,038

[22] Filed: Apr. 5, 1999

[51] Int. Cl.[7] ..... F28G 1/12

[52] U.S. Cl. ..... 165/95

[58] Field of Search ..... 165/95; 15/3.5, 15/3.51; 134/104.3

[56] References Cited

U.S. PATENT DOCUMENTS 2,801,824 8/1957 Taprogge .
4,473,787 9/1984 Schick .
4,569,097 2/1986 Echols .
4,696,318 9/1987 Smith .
4,830,099 5/1989 Eimer .
5,010,950 4/1991 Voith ..... 165/95
5,433,229 7/1995 Blair ..... 134/104.3
5,647,428 7/1997 Echols ..... 165/95
5,680,665 10/1997 Anson et al. ..... 15/3.51

*Primary Examiner*—Allen Flanigan
*Attorney, Agent, or Firm*—Steven D. Boyd

[57] ABSTRACT

Apparatus for recovering floating hard-body tube cleaning elements from cooling water downstream of a heat exchanger. The floating hard-body tube cleaning elements are removed from the water flowing through a cooling tower distribution header and recovery from a modified distribution header vent.

4 Claims, 2 Drawing Sheets

TUBE CLEANER RECOVERY SYSTEM

FIELD OF THE INVENTION

The present invention relates to the cleaning of the tubes of heat exchangers. More particularly, the present invention relates to a system for recovering floating tube cleaning elements from a cooling tower riser assembly.

BACKGROUND OF THE INVENTION

Heat exchangers are necessary components of many industrial processes. A common form of heat exchanger is a shell through which a large number of tubes pass, the shell enclosing the fluid to be cooled and the tubes conducting a coolant for removing the heat. Such heat exchangers are commonly used in refining, petrochemical and power generation industries. In particular, in steam power plants, the steam condenser employs cooling water passing through many thousands of heat exchanger tubes. After steam has passed through a turbine, it is condensed in the shell of the heat exchanger. The efficiency of heat removal from the steam by the cooling water determines the back pressure at the turbine exhaust, and this pressure significantly affects the total energy extracted from the steam. Energy lost by not extracting it from the steam leads directly to an increase in power generation costs.

To maintain maximum heat transfer efficiency in a tube and shell heat exchanger, it is necessary to minimize buildup of film, such as bio-growth or a chemical scale, on the internal surface of the tubes of the heat exchanger. Chemical and mechanical treatments are used to inhibit the formation of or remove such films. On-line and off-line mechanical techniques have been used for removing such film buildups. On-line techniques, in which the heat exchanger is not taken out of service as the tubes are cleaned are the subject of the present invention.

There are several types of cooling water systems. In "once-through" systems, the cooling water passes through the heat exchange system only once. The warmed water is discharged—often to its original source; a river, lake, well or the ocean. In closed recirculating systems, the water is completely confined within the steam pipes and heat exchangers. The heat is generally dissipated by heat exchange with air. In open recirculating cooling tower systems, the water is continuously reused, but the system is open to the atmosphere in a cooling tower.

Cooling towers, a component of many cooling water systems are designed in many different configurations. Common to all is a means for forming a large surface area between cooling water and the air. Air is drawn through the dispersed liquid in a horizontal direction in cross-flow cooling towers and in a vertical direction in counterflow cooling towers. The air may be driven by natural draft and a large chimney, such as the hyperbolic towers commonly associated with nuclear power plants, or by mechanical drivers-normally fans driven by electric motors. In a cooling tower, the water is pumped to a level where it falls by gravity, either through orifices or spray nozzles, and creates droplets or a splash zone. Means are provided for dispersing the water over the area of the "fill" through which it will fall. This dispersal may be through conduits into a pan, or open basin, or through a flume.

Cleaning of the tubes of heat exchangers on-line by pumping sized solid bodies through the tubes is known in the art. U.S. Pat. No. 2,801,824 describes a system wherein deformable spheres made of a foamed elastomer are pumped through the tubes and recovered down steam of the heat exchanger. There is a considerable body of art, such as, for example, that described in U.S. Pat. No. 4,830,099 related to apparatus for removing such deformable cleaning bodies from cooling water downstream from the heat exchanger. These devices involve screens in a particular configuration which separate the deformable cleaning bodies from the flow, with the cleaners removed from the screens by additional suction means. Such devices are used as an integral part of a conduit or closed flow stream immediately downstream of the heat exchanger.

In recent years, a new type of on-line tube cleaner has been described, which is called a "hard body"-type cleaner. These cleaners have a body which is generally spheroidal in shape and made of a material such as polypropylene plastic. Attached to the body is a flexible disk of plastic such as polyurethane which is designed to wipe and clean the inside wall of a heat exchanger tube as the body is pumped through the tube. Hard-body tube cleaners are disclosed in U.S. Pat. Nos. 4,473,787 and 4,569,097.

U.S. Pat. No. 4,696,318 discloses a system which can be used to remove "hard-body" type (i.e., non-deformable) cleaning bodies from open recirculating cooling water systems. The removal is accomplished by adjusting the density of the cleaning bodies such that they float and then recovering them by skimming from a stream downstream of the steam condenser of a power plant. A stream suitable for recovering hard-body cleaners utilizing the floatation method of recovery is not available in many power plants. In some plants, excess turbulence in the stream prevents successful recovery by flotation.

Apparatus for recovering floating, hard-body type cleaning elements in open water surfaces available in or around some cooling water systems is disclosed in U.S. Pat. No. 5,647,428.

SUMMARY OF THE INVENTION

In the present invention, apparatus and a method are disclosed for removing floating, hard-body type cleaning elements from the cooling water downstream of a heat exchanger. A screen device is oriented in a distribution header of a cooling tower. The screening device is oriented below the distribution header vent so that floating hard-body cleaning elements which impact the screen, float upward into the vent and over a weir provided in the vent. Water and cleaning elements which spill over the weir impact a slanted bar screen. Water flows through the slanted bar screen and back to the distribution header. The cleaning elements are intercepted and directed by the slanted bar screen to a tube cleaner return line for re-injection upstream of the heat exchanger. The apparatus and method of the present invention can be easily retrofitted to a distribution header of a cooling tower to screen all of the water flowing to the cooling tower in cooling tower systems which do not include an open surface such as a sealed pit.

DETAILED DESCRIPTION OF THE PREFERRED EMBODIMENT

Figure 4:
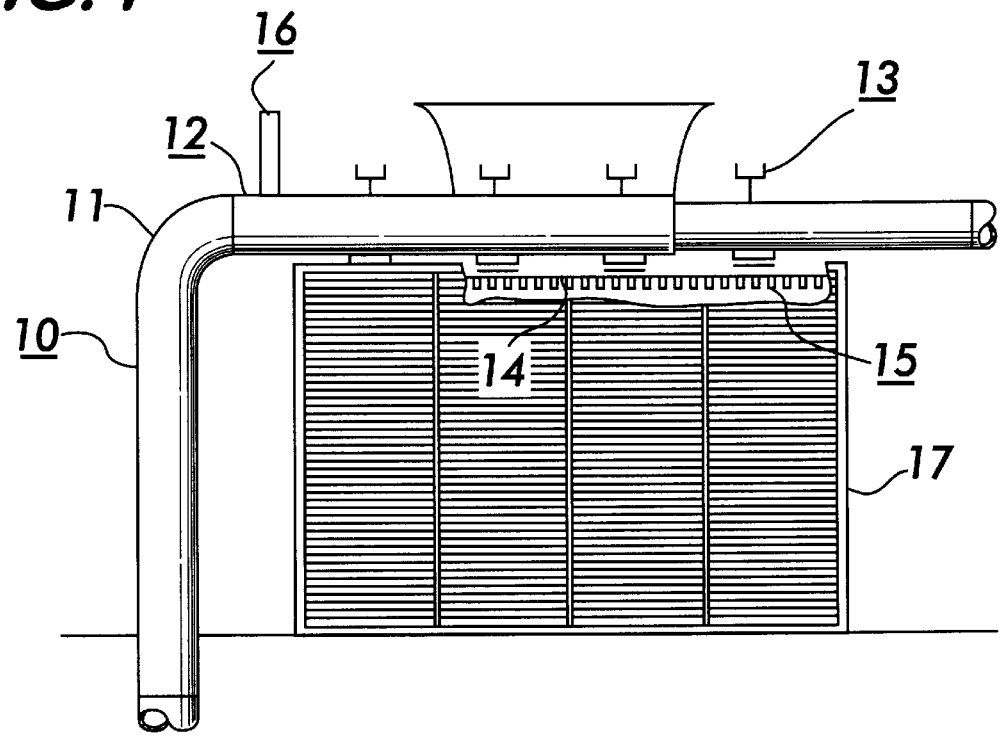
FIG. 4 is a side view, partially in cross section of a mechanical draft cooling tower.

Referring to FIG. 4, the basic elements of cooling water flow for a mechanical draft cooling tower is shown. Condenser cooling water returning from the condenser passes through riser 10 into a distribution header 12, through distribution valves 13, onto distribution deck 14 and through nozzles 15 onto the cooling tower fill 17. An atmospheric vent 16 is oriented downstream of riser elbow 11 to allow air to escape the system, especially during start-up. The water level or head in the system is maintained higher than the distribution header 12, and somewhere between the top of distribution header 12 and the top of vent 16. The top of vent 16 is typically 1–12 feet above the centerline of distribution header 12.

The tube cleaner collection apparatus of the present invention is designed to replace or modify vent 16 of a distribution header 12.

Figure 1:
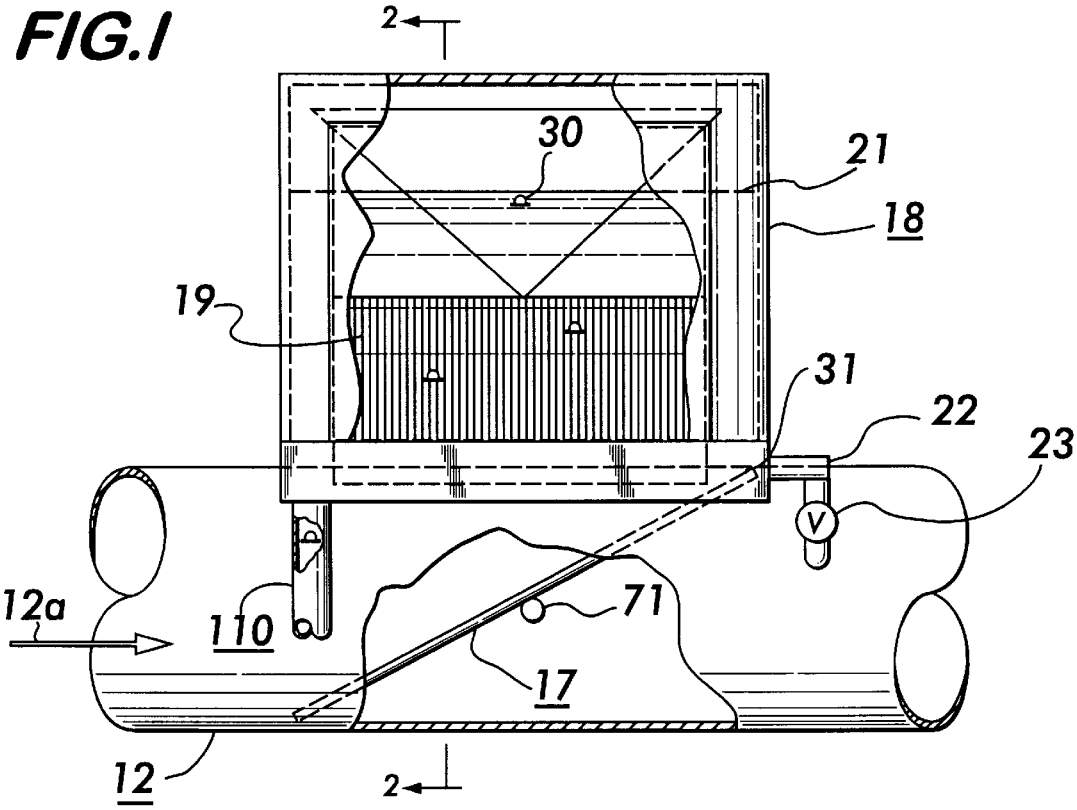
FIG. 1 is a side view partially in cross section of the collection apparatus.
Figure 2:
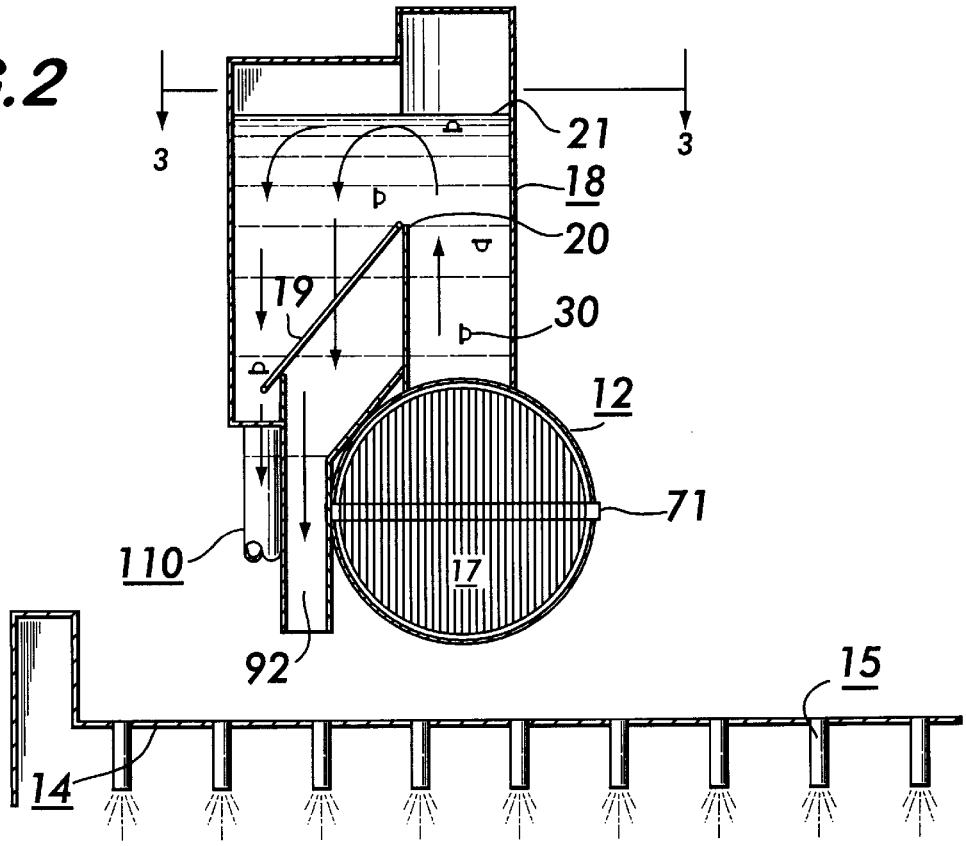
FIG. 2 is an end view along line 2—2 of FIG. 1.

As shown in FIGS. 1 and 2, a bar screen 17 is oriented in distribution header 12, below expanded vent 18. The bar screen 17 is angled upward in the direction of flow of water, arrow 12*a*. Bar screen 17 is preferable mounted on a pivot axle 71 which allows bar screen 17 to be pivoted to a downward sloping orientation to allow periodic back washing for debris removal.

Figure 3:
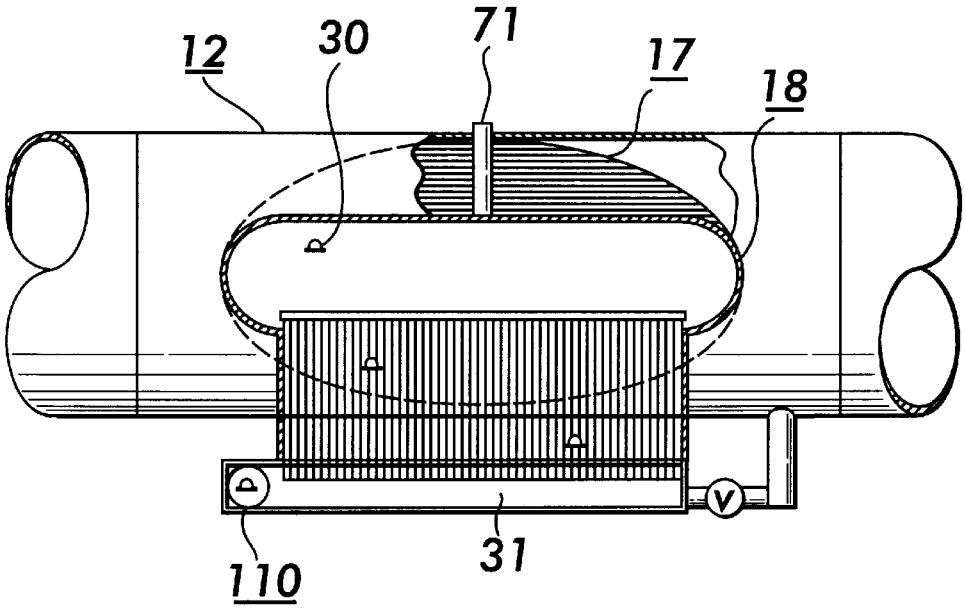
FIG. 3 is a top view along line 3—3 of FIG. 2.

The typical prior art atmosphere vent 16 (shown in FIG. 4) is replaced by the expanded vent 18 (shown in FIG. 1) in the present invention. The expanded vent 18 is preferably an oval shape in cross-section (see FIG. 3). The expanded vent 18 of the present invention includes a weir 20 located such that the normal operating water level 21 (represented by a dotted line) in expanded vent 18 is above weir 20. Water which over flows weir 20 falls downward through inclined bar screen 19, through conduit 92 and onto distribution deck 4.

Floating hard-body tube cleaning elements 30 which are carried from the heat exchanger, to the cooling tower by the water flowing through riser 10, impact bar screen 17. Bar screen 17 has bar spacing sufficiently close to stop the tube cleaning elements 30 while minimizing back pressure. Tube cleaning elements 30 float upward into expanded vent 18 and over weir 20. There, tube cleaning elements 30 impact inclined bar screen 19. Inclined bar screen 19 has a bar spacing sufficiently close to stop the tube cleaning elements 30. Tube cleaning elements 30 stopped by inclined bar screen 19 are moved, by gravity, down the incline to collection trough 31. Collection trough 31 is provided with a water inlet 22 controlled by inlet valve 23. Inlet valve 23 is opened to provide sufficient water to flow through collection trough 21 to carry tube cleaning elements 30 therein through tube cleaner return line 10. Tube cleaner return line 10 carries tube cleaner elements 30 back to the upstream side of the heat exchanger (not shown) for re-injection.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

What is claimed is:

1. A floating tube cleaning element collection apparatus for cooling tower water flow path having a riser which directs water from a heat exchanger to a cooling tower distribution header, said distribution header having a vent extending upward therefrom to an end open to the atmosphere, said vent being at least partially filled with water, comprising:

a) a screen in said distribution header angled upward in the direction of water flow, oriented below said vent, whereby floating tube cleaning elements carried by the water flowing through said distribution header impact said screen and float upward into said vent;

b) a weir in said vent over which water from said distribution header flows and drops downward to a distribution deck through an inclined bar screen whereby floating tube cleaning elements are intercepted and separated from said water; and c) tube cleaning element collection means which receives tube cleaning elements from said inclined bar screen by gravitational action and directs said tube cleaning element to a return conduit whereby said tube cleaning elements are returned for reuse.

2. The floating tube cleaning element collection apparatus of claim 1 wherein said screen is mounted on a pivot whereby it can be selectively angled downward in the direction of water flow.

3. The floating tube cleaning element collection apparatus of claim 1 wherein said tube cleaning element collection means comprises a trough having water flowing there through.

4. The floating tube cleaning element collection apparatus of claim 3 wherein water flowing through said trough is controlled by a valve.

* * * * *